United States Patent [19]

Carbonnel

[11] 3,972,369

[45] Aug. 3, 1976

[54] RAPID LOW-PRESSURE CASTING INSTALLATION

[75] Inventor: Henri Carbonnel, Antony, France

[73] Assignee: Groupement pour les Activities Atomiques et Avencees "GAAA", Le-Plessis-Robinson, France

[22] Filed: Nov. 4, 1975

[21] Appl. No.: 628,624

[30] Foreign Application Priority Data

Nov. 4, 1974 France ..... 74.36579

[52] U.S. Cl. ..... 164/147; 164/303; 164/337

[51] Int. Cl.[2] ..... B22D 17/30; B22D 27/02; B22D 35/04

[58] Field of Search ..... 164/113, 119, 130, 147, 164/303–306, 309–312, 316, 322, 323, 337, 341; 222/533, 536, DIG. 2; 141/279

[56] References Cited

UNITED STATES PATENTS

| | | | |
|---|---|---|---|
| 2,224,982 | 12/1940 | Morin | 164/147 X |
| 3,674,062 | 7/1972 | Ellers et al. | 141/279 X |
| 3,763,925 | 10/1973 | Sieger | 164/341 |

*Primary Examiner*—Robert D. Baldwin
*Attorney, Agent, or Firm*—Sughrue, Rothwell, Mion, Zinn & Macpeak

[57] ABSTRACT

Installation in which an immersed electromagnetic pump feeds successively at least two low-pressure casting moulds, the feeding of the second mould being effected during the cooling of the first mould, wherein the moulds are arranged on either side of the pump and of the vertical line of the maintaining ladle and at a level higher than the latter. Moreover, the contact and interconnection and locking operations of the pipe for feeding molten metal to the mould are simplified and accelerated. Numerous applications to the casting of aluminum parts, cast metal parts or steel parts.

8 Claims, 3 Drawing Figures

RAPID LOW-PRESSURE CASTING INSTALLATION

BACKGROUND OF THE INVENTION

1. Field of the Invention

The present invention concerns a rapid low-pressure casting installation.

2. Description of the Prior Art

It is known that at present, a low-pressure casting installation of an industrial kind comprises 3 elements:

a maintaining furnace containing a fluid-tight crucible capable of withstanding pressures of 1 to 1.5 bars;

a pneumatic means ensuring the upward conveying of the metal towards the furnace either by gas or air pressure or by depression; and a contact and interconnection means comprising the supply pipe for bringing the molten metal from the crucible to the mould and the device for the centring and fluid-tight contact between that pipe and the input orifice of the mould.

A great step has been made in the improving of low-pressure casting installations when it was possible to substitute an electromagnetic pump for pneumatic means thus making it possible to ensure the upward conveying of the liquid metal towards the mould and thus to avoid enclosing all or a part of the crucible containing the molten metal in a fluid-tight enclosure.

It was thus possible to effect the filling of the mould more regularly, then to bring the forging pressure up to values twice as great as those previously obtained, since the solidity of the walls of the crucible was no longer affected. With forging pressures in the order of 3 bars, it was possible to obtain by that method cast parts having a fineness which it was impossible to obtain up till then by conventional low-pressure casting methods. Low-pressure casting installations using immersed electromagnetic pumps have therefore made it possible to obtain a certain number of improvements. More particularly, it is now easy to regulate the injection speed and the forging overpressure by varying simply the service tension of the pump. The electromagnetic pump can also be fitted to any furnace, providing that it is fitted with a tank in which the pump can be inserted. Thus, the use of overpressure gases with all the leakages which they cause is avoided. Lastly, it is now possible to re-load the furnace while the installation is in service and to insert therein products for refining the metal without interrupting the operation of the installation.

Nevertheless, despite the various improvements exposed hereinabove, low-pressure casting remains an expensive operation requiring the use of expensive machines which remain unused during the cooling time of the moulds and during the refractory washing thereof. The inventor has sought to reduce the stoppage time of the pump during those periods. It is known, indeed, that on referring to the diagram of the operations, the contact and interconnection operation of the pump and the mould, followed by the putting of that mould under pressure and followed by the maintaining of the pressure until the moment when the base of the mould is fixed, represent fairly a time substantially equal to the complete solidifying and cooling time of the part cast in the mould, followed by the time necessary for the removing of the cast part, the subsequent refractory washing time of the mould and the positioning of the cores. In this way, the inventor has observed that the electromagnetic pump remains in general, unused during half the casting cycle. Making use of the specific properties of immersed electromagnetic pumps, it appeared an advantage to make the pump go through a rotation of nearly 180° after a casting operation and to proceed with a second casting operation on a second mould placed at the same distance from the pump during the cooling of the first mould. Such an operation is naturally possible only if a certain number of modifications have been made to the mould, to the molten metal supply pipe, to the means for centring those two elements and to their fluid-tight contact; it being compulsory for these operations to be effected in a very short period of time not causing any extra stoppage.

SUMMARY OF THE INVENTION

The object of the invention is therefore a rapid low-pressure casting installation comprising a maintaining ladle containing molten metal at least part of which is in the open air, only one electromagnetic pump partly immersed in the portion of the maintaining ladle situated in the open air, at least two moulds arranged on either side of the pump at a higher level than the maintaining ladle, an injection pipe, contact and interconnections means integral with the electromagnetic pump and means for the rapid locking of the said injection pipe to the said moulds, characterized in that it comprises said at least two moulds being arranged at the same distance from the pump, outside the vertical line of the maintaining furnace and in that the said moulds are connected each in turn to the pump through the rapid contact and interconnection and locking means.

To reduce the maneuvering time, the drawing up operation and the locking phase must be effected very rapidly. That speed imperative entails the improving of a certain number of particular arrangements; some of them concerning the injection pipe being integral with the locking means and others concerning more directly the pipe being connected to the mould. Indeed, when the cooling device known per se arranged at the base of the cast part has caused the congealing of a layer of metal, the injection pipe can be detached from the mould, the electromagnetic pump can be driven in a rotating movement on its axis by a device also known per se until the end of the injection pipe comes into contact with the input of the following mould to be filled.

The operations for the contact and interconnection and the locking of the pipe on the mould can then be effected. The implementing of the locking device according to the invention has a self-centring effect which brings the axis of the injection pipe into coincidence with the axis of the input of the mould. The injection pipe being rigid, it is, in reality, the assembly formed by the pump and the injection pipe which moves by a few millimeters within the limits of the play allowed for the pump by its suspension device. When the locking is ended, the mould filling operation can begin.

The various elements which go to make up the rapid casting installation are exposed in greater detail in an example of embodiment described hereinbelow.

DESCRIPTION OF THE PREFERRED EMBODIMENT

Figure 1:
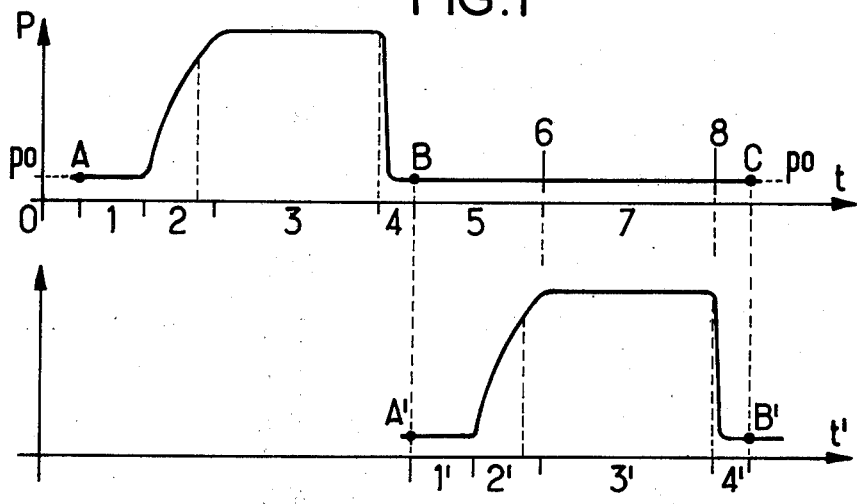
FIG. 1 is a diagram of the operation of the installation of the present invention.

The top graph in FIG. 1 shows the pressure of the liquid metal in the injection pipe as a function of time when the electromagnetic pump feeds only one mould. It will be seen that the if the contact and interconnection operation begins at A, during the time 1 corresponding to the contact and interconnection operation, the pressure is maintained at a value $p_o$ making it possible to maintain the molten metal in the injection pipe to avoid untimely congealing of that metal and to reduce the oxidation on the inside walls of that pipe.

When the contact and interconnection phase 1 is ended, the pressure is rapidly increased so as to fill the mould in accordance with the part 2 of the representative curve. When the mould is full, the pressure is still made to rise up to the forging pressure, which is maintained during a certain time (part 3 of the curve). A cooling device operating on a relatively thin layer of metal is situated just at the base of the cast part. The pressure is brought to $p_o$ as soon as congealing is obtained at the level of the said thin layer so as to enable the excess molten metal to go down again towards the maintaining ladle and to avoid congealing the neighbouring parts of the injection pipe. In the mould, the cooling operation 5 will take place, followed by the mould opening operation 6, the removal of the cast part 7 and lastly the refractory washing 8. The mould is then ready for another contact and interconnection operation.

When these various operations are shown on a diagram such as the top graph in FIG. 1, it is observed that in the very great majority of cases, the sum of the periods corresponding to the operations (1 + 2 + 3 + 4) is very substantially in the same order as the period corresponding to the sequence of operations (5 + 6 + 7 + 8). Now, these latter operations can be effected without any intervention from the electromagnetic pump, so that it appeared an advantage to disconnect the end of the feed pipe from the mould when the point B of the diagram is reached and to feed, without delay, a second mould according to the bottom diagram in FIG. 1 during the cooling of the first mould. For these operations to be an advantage, it is obvious that it is necessary to make the feed pipe pass from the first mould to the second in as short a time as possible. It is true that when the part to be cast has a certain volume, the cooling time can become longer than that which is provided for in FIG. 1. But when that time becomes close to twice the time required for operations (1 + 2 + 3 + 4), it becomes an advantage to have a third mould ready. It will therefore be seen that when casting large parts according to the low-pressure technique, it will be possible with the same device to cast a great number of parts and to increase by as much the efficiency of the casting installation.

Figure 2:
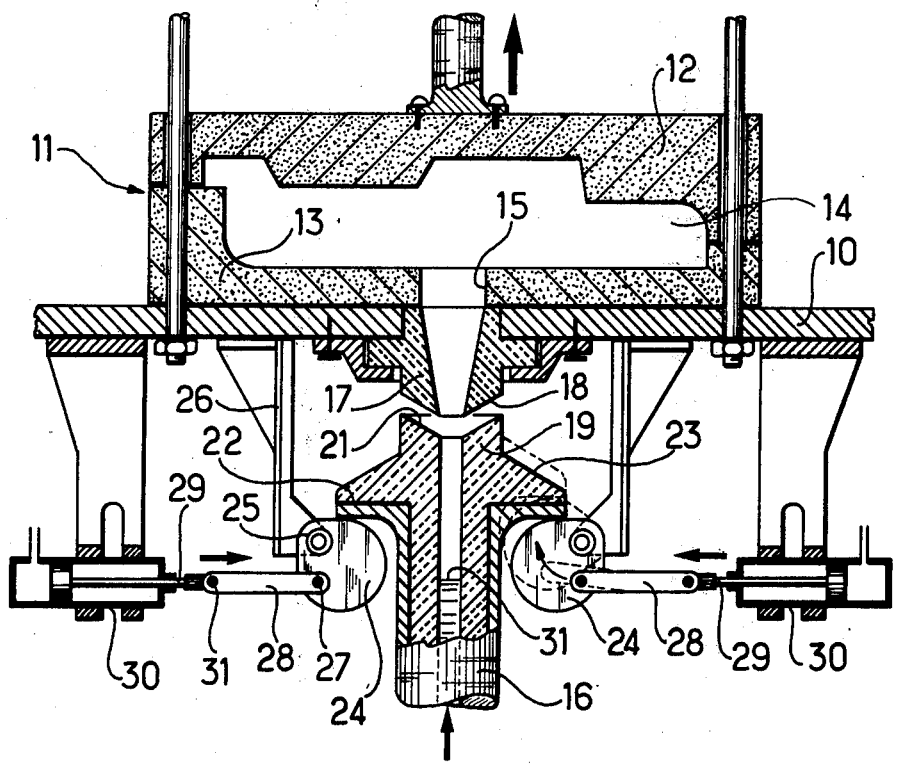
FIG. 2 is a cross-sectional view of the elements of the installation taking part in the contact and interconnection.

FIG. 2 makes it possible to understand the advantages of the installation according to the invention. The low-pressure casting mould 11 comprising 2 parts 12 and 13 between which is moulded the part 14, is shown positioned on the table 10. A known cooling means (not shown) which produces at that level, the forming of a layer of solid metal which makes it possible to uncouple the cast part 14 when still liquid or at least during solidifying of the molten metal brought by the pipe 16, is arranged at the base 15 of the cast part. The level 31 of the liquid metal corresponding to the pressure $p_o$ in the injection pipe is established at a certain distance below the congealed layer. The mould is extended downwards by a ceramic part or block 17 having an inside like a slightly tapering funnel; the bottom face 18 of that ceramic block 17 assumes a truncated conical shape whose widest portion is turned upwards.

The top part of the supply pipe 16 is also constituted on the inside by a cylindrical ceramic block 19 of the same type as the block 17. The top thickness edge 21 of that block is cut in a truncated conical shape having a corresponding opening as that of the bottom face 18 of the ceramic block 17. The opposing faces 18 and 21 are polished carefully, so that when the two adjacent ceramic blocks 17 and 19 come into contact and are locked against each other, the face 21 is applied in a fluid-tight manner on the face 18 and the two passages becoming coaxial.

When, subsequent to a transfer manoeuvre of the pump and of its feed pipe, the end 21 of the feed pipe is in the immediate vicinity of the face 18 of the input of the mould and the coincidence of the axes of the two passages is effected to within a few millimeters, the act of advancing the feed pipe 16 against the input of the mould brings the two smooth faces 18 and 21 into contact, makes them slide against each other and brings them into closer contact on condition, however, that this contact be effected very progressively, without any sudden movement. This essential condition in the operation of the device is fulfilled by providing the outer casing of the injection pipe 16 with studs 22 and 23 on each side of the pipe. A cam having a semi-circular eccentric cheek 24, whose axis or centre of rotation 25 is supported by a rigid T 26 bears on each of these studs.

A jack 30 actuates the axle 27 by means of an arm 29 which slides in the jack and of a link rod connected on one side to the axle 27 and on the other side to the axle 28 placed at the end of the arm 29. In the retracted position, the semi-circular cheeked cam 24 comes into contact with the stud without raising the injection pipe. When the arm 29 advances, it very progressively brings the face 18 into contact with the face 21 and enables the relative sliding of these latter before the blocking. The two parts are then locked in a fluid-tight manner, the liquid metal pumped by the pump feeding the pipe 16 fills the mould 10.

In certain configurations, the two studs 22 and 23 have been replaced by a ring having a rectangular cross-section for reasons of ease in machining. When the mould is full and the molten metal no longer flows, a layer of the molten metal congeals at the level of the cooling device. By a reverse action of the jack 30, the ceramic parts 17 and 19 are separated from each other after having brought the pressure of the molten metal to $p_o$.

The cast part then undergoes a cooling whose duration depends on its dimension. In the installation according to the invention, the mould is not situated above the maintaining ladle and is situated preferably at a certain distance from the latter; the result of this is that its cooling is thereby speeded up. Moreover, in its position away from the vertical line of the maintaining ladle, the bottom face of the mould is not subjected to the radiation of the surface of the molten metal contained in the ladle. Now, it is known that this radiation has a great thermal effect on the bottom face of the mould and that, at the time of the cooling of the part, there appears, between the elements 12 and 13, constituting the mould, tensions which are liable either to alter the quality of the moulding, or to shorten the service life of the mould. These defects are avoided in the device according to the invention.

When the part has reached the unmoulding temperature, the mould is opened; the cast part is removed and the refractory washing of the mould is effected without delay, with a view to beginning the next casting operation.

Figure 3:
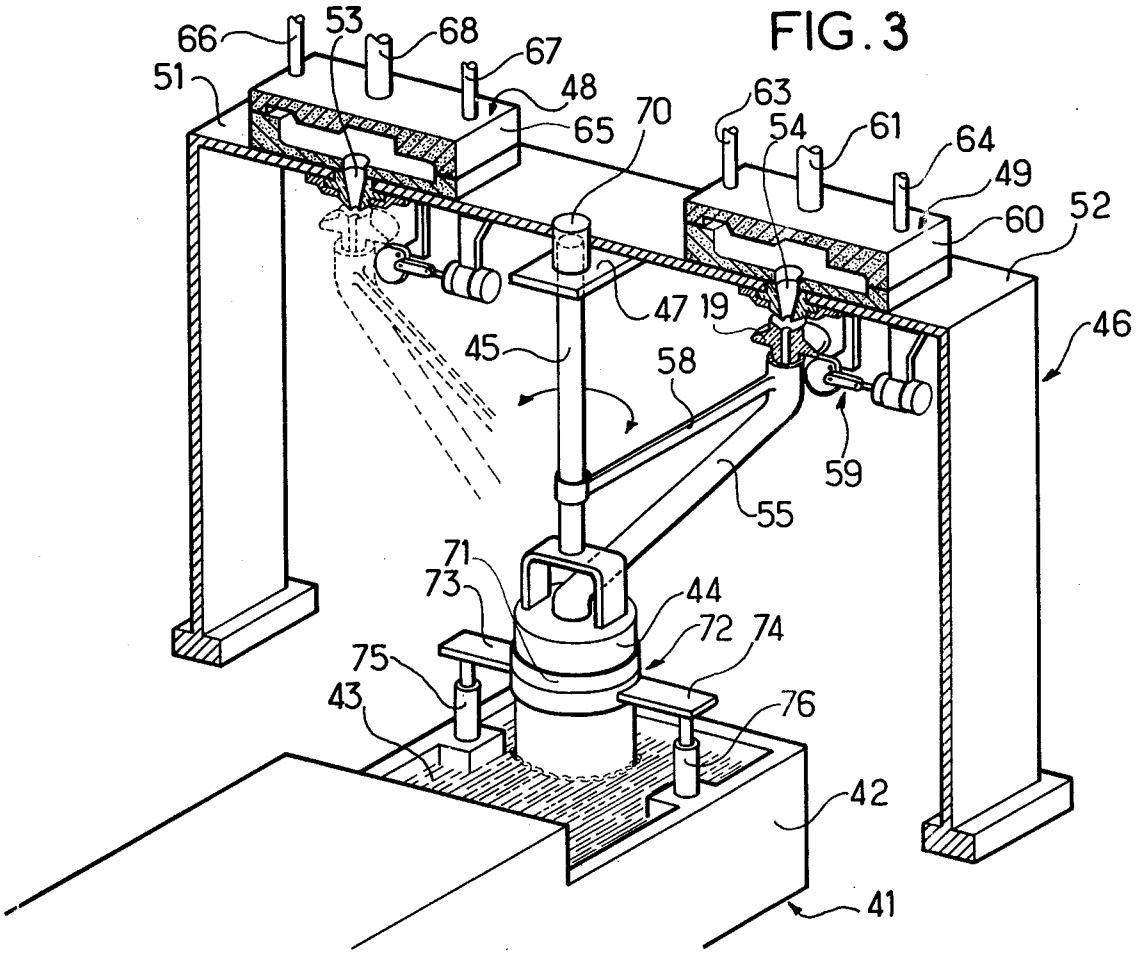
FIG. 3 is a perspective, partial sectional view of an installation having a constant level.

FIG. 3 makes it possible to understand better all the advantages of the installation. The maintaining ladle for the molten metal has been shown at 41 with a portion 42 kept in the open air. It is known that if aluminium, for example, is treated, a thin layer of oxide which, being air-tight, prevents greater oxidation of the molten metal, is formed at the surface 43 of the molten metal in contact with the air. The electromagnetic pump 44, being immersed, draws off the pure molten metal under the layer of oxide 43. The pump 44 is maintained in the molten metal by an element 45, constituted for example by a column which can slide, if necessary, vertically in relation to a fixed element 46, a gantry, for example. That column 45 can rotate on its axis through a well-defined angle by means of a motor element 47 shown as fixed to the gantry 46. The gantry 46, the column 45 and the motor 47 are of a known type and will not be described.

The tables 51 and 52 of the moulds 48 and 49 are integral with the gantry 46. The moulds bear, at their base, ducts 53 and 54 for ceramic parts, such as 17, described hereinabove with reference to FIG. 2. Likewise, the molten metal pipe 55 of the pump 44 bears, at its top end, a truncated conical ceramic part 19.

The mould 49 comprises a top part 60 which is pulled upwards by the arm 61 at the time when the cast part is solidified. That top portion 60 slides upwards along the two columns 63 and 64, driving the cast part upwards. The latter is then released in the known way. The mould 48 bears homologous elements: a top portion 65 sliding upwards along the column 66 and 67 when it is pulled upwards by the arm 68. A moulding device in which the top portion is pulled upwards by lateral arms has also been produced.

The contact and interconnection is effected by making the column 45 rotate through an angle predetermined with precision.

The arm 58 integral with that column, drives the molten metal pipe 55 in such a way that the truncated conical part is brought into the immediate vicinity of the ceramic input 53, for example.

The clamping device, constituted, to great advantage, by a jack having an eccentric cam 59, applies the truncated conical part 19 against the ceramic part limiting the duct 53 and effects the centring of those two parts as been described hereinabove with reference to FIG. 2.

When the filling of the mould 48 is ended, the pipe 55 is disconnected from the mould 48 and brought into contact with the ceramic part limiting the cone 54 of the mould 49 by rotation of the shaft 45 driven by the motor 47, while the mould 48 cools.

The ridigity of the connection of the pump with the pipe 55, as well as the rigidity of the pipe 55 itself have led the inventor to impart to the suspension of the pump a certain flexibility. This has been obtained more particularly by imparting to the rotation shaft 45 a slight freedom to slide longitudinally by a few millimeters in relation to the outer sleeve 70. In this way, when the pipe is brought with precision by the arm 58 to the vertical line of the input of the mould, the jack 30 raise the truncated conical part 57 until it comes into contact with the ceramic input 53 and causes a very slight upward linear movement of the assembly formed by the pump and by the pipe 55. That movement is made easy by the almost complete compensation of the weight of the mobile parts.

In other experimental devices, the pump is suspended flexibly in relation to a collar 71 integral with the pump body. That collar 71 can in its turn rotate about a flexible suspension 72 formed by two rigid arms 73 and 74 bearing, on the one hand, on the collar 71 and, on the other hand, on the edge 42 of the part of the ladle kept in the open air by means of two dampers 75 and 76.

In certain experimental devices, the two means ensuring the flexibility of the suspension of the pump have been implemented in combination with success.

Thus, it is possible to double the casting rate, that is, to double the productivity of the pump and of the maintaining ladle.

Although the device which has just been described may appear to afford the greatest advantages for the implementing of the invention, it will be understood that known elements such as the suspension means and rotation means for the pump and its pipe, the cooling means for a layer of molten metal at the base of the cast part can be replaced by other elements fulfilling the same technical functions without going beyond the scope of the invention.

I claim:

1. In a rapid low-pressure casing installation comprising a maintaining ladle containing a molten metal at least part of which is open to air, an electromagnetic pump partly immersed in that portion of the maintaining ladle situated in the open air, at least two moulds arranged on either side of the pump at a higher level than the maintaining ladle, an injection pipe and contact and interconnection means integral with the electromagnetic pump and means for the rapid locking of said injection pipe to said moulds, the improvement wherein: said at least two moulds are arranged at the same radial distance from the pump, outside the vertical line of the maintaining furnace and wherein means are provided for connecting said moulds each in turn to the pump through said rapid contact and interconnection means and said locking means.

2. The rapid low-pressure casting installation according to claim 1, wherein said rapid contact and interconnection means comprise a connecting part arranged at the base of the mould and a part forming the output end of the injection pipe and wherein both parts are made of a ceramic substance.

3. The rapid low-pressure casting installation according to claim 2, wherein the opposed faces of the input of the mould and of the output of the injection pipe are of truncated conical shape whose widest part is at the upper end thereof.

4. The rapid low-pressure casting installation according to claim 3, wherein the two opposed faces are polished and fit perfectly into each other.

5. The rapid low-pressure casting installation according to claim 4, wherein the locking means of the input face of the mould and of the output face of the injection duct comprise two diagrammatically opposite studs arranged in the vicinity of the end of the injection pipe.

6. The rapid low-pressure casting installation according to claim 5, wherein the rapid locking means further comprises a cam with an eccentric semi-circular cheek and a jack for progressively pressing the output face of the injection pipe against the input face of the mould.

7. The rapid low-pressure casting installation according to claim 4, wherein the locking means for the input face of the mould and of the output face of the injection pipe comprise a ring having a rectangular cross-section borne by the injection pipe in the vicinity of the output.

8. The rapid low-pressure casting installation according to claim 7, wherein the rapid locking means further comprises a cam with an eccentric semi-circular cheek and a jack for progressively pressing the output face of the injection pipe against the input face of the mould.

* * * * *